United States Patent [19]

Snyder

[11] Patent Number: 4,479,130

[45] Date of Patent: Oct. 23, 1984

[54] BROADBAND ANTENNAE EMPLOYING COAXIAL TRANSMISSION LINE SECTIONS

[76] Inventor: Richard D. Snyder, 646 Pinehurst Ave., Placentia, Calif. 92670

[21] Appl. No.: 383,627

[22] Filed: Jun. 1, 1982

Related U.S. Application Data

[63] Continuation-in-part of Ser. No. 270,746, Jun. 5, 1981, abandoned.

[51] Int. Cl.[3] ..... H01Q 9/16

[52] U.S. Cl. ..... 343/802; 343/815; 343/822

[58] Field of Search ..... 343/802, 820–822, 343/830, 831, 864; 343/794, 801, 815, 825, 827, 841

[56] References Cited

U.S. PATENT DOCUMENTS

| | | | |
|---|---|---|---|
| 2,313,046 | 3/1943 | Bruce | 343/828 |
| 2,321,454 | 6/1943 | Brown | 343/802 |
| 2,539,680 | 1/1951 | Wehner | 343/831 |
| 2,648,768 | 8/1953 | Woodward | 343/702 |
| 2,975,423 | 3/1961 | Wells | 343/791 |
| 3,151,327 | 9/1964 | Levy et al. | 343/831 |
| 3,358,286 | 12/1967 | Heins | 343/831 |
| 3,582,952 | 6/1971 | Heins | 343/831 |
| 3,656,167 | 4/1972 | Lea | 343/882 |
| 4,209,790 | 6/1980 | Newcomb | 343/831 |

*Primary Examiner*—Eli Lieberman

*Attorney, Agent, or Firm*—Grover A. Frater

[57] ABSTRACT

The deviation in operating frequency which antenna system elements can handle without serious transmission line mismatch is increased by constructing the antenna such that the inner portions (40, 42) of its legs (40,48 and 42,50) are formed of coaxial transmission line connected so that the outer conductor serves as part of the radiator, and so that the inner and outer conductor of the line cooperate to form compensation stubs whose impedance varies with frequency in a manner to cancel or oppose the reactance which the antenna legs exhibit with frequency change. The stubs are connected in series or in parallel with the antenna feed point and parasitic elements. Surge impedance is selected so that the antenna driven elements (nearly resistive) and signal source, and parasitic elements that incorporate the invention, are mismatched at band end frequencies and center band frequency in apparoximately like amount. The impedance is selected such that the antenna (somewhat reactive) and signal source are more nearly matched at frequencies midway between center band frequency and band edge frequencies.

38 Claims, 19 Drawing Figures

BROADBAND ANTENNAE EMPLOYING COAXIAL TRANSMISSION LINE SECTIONS

CROSS-REFERENCE TO RELATED APPLICATION

This application is a continuation-in-part of U.S. Application, Ser. No. 270,746, filed June 5, 1981 for BROADBAND ANTENNA, and now abandoned.

TECHNICAL FIELD

This invention relates to dipole or Hertzian and Marconi or monopole type antennae which exhibit broadband characteristics, and to broadband parasitic antenna elements and to antenna arrays which employ such antennae and elements.

BACKGROUND ART

There are a number of radio services in which it is necessary or desirable that a radio transmitting and receiving antenna be capable of operation at any frequency within a relatively broad band of frequencies.

The demand for more efficient use of radio frequency spectrum space can be satisfied by time division multiplexing, and that can be made more efficient if frequency multiplexing is added. The limited ability to change transmitter (and receiver) frequency is no longer the boundary condition that limits effective use of the latter. The advent of the microprocessor controlled frequency synthesizers and broadband power amplifiers has removed the transmitter as the limiting factor to frequency multiplexing, and the major problem has become antenna band width limita- tion.

Much work has been done to provide broadband antennae with limited success. Certainly, commercial success has been limited. Less work appears to have been done and, certainly, even less success has been achieved in broadbanding directional antennae that employ passive radiators or parasitic elements.

While the advance of frequency multiplexing points up one need for broadband antenna systems, most radio communication services still employ or are based on single frequency carriers whether or not the carrier is transmitted. Those radio services also are in need of better broadband antenna systems. That is true, among others, of the military and amateur radio services. In one example, the 75–80 meter amateur band extends from 3.5 MHz to 4.0 MHz, a range of essentially thirteen percent of midband frequency. Amateur licensees may operate at any frequency within that band, but not all of them can do that. An antenna presents a different impedance to a transmitter and receiver at different frequencies, and the impedance of the standard dipole and Marconi type antennae changes more from 3.5 MHz to 4.0 MHz than most modern transmitters can accommodate. The standard, or reference, antenna is one-half electrical wave length long. It is divided at the center, and the feed lines are connected one to each leg. Mounted one-quarter wave length, or multiple thereof, above a perfectly conductive ground, such an antenna presents a 73 ohm radiation resistance at the feed point. If the frequency is increased, the impedance seen by the feed line is a combination of resistance and inductive reactance. If the frequency is decreased, the impedance presented to the feed line is a combination of resistive and compacitive reactance.

The transmitter output circuit is a resonant circuit or untuned network set to the transmission frequency.

When the antenna presents a reactive load to the transmitter output circuit, the effective output circuit is untuned with attendant high SWR generated on the feed line. The result can be generation and radiation of harmonic signals, excessive and damaging voltages and circulating currents, and reduction of efficiency and radiated energy. The transmitter can be protected by the inclusion of "matching" networks in the transmission feed line from the transmitter to the antenna, but the use of a matching network solves only part of the problem. In practice, it is necessary to retune the transmitter or the matching network when changing transmitting frequency more than two or three percent.

The amount of retuning that is required when changing frequency across a radio service band can be reduced by the use of a "broadband" antenna. Such an antenna incorporates variations from the standard dipole or Marconi antenna the effect of which is to minimize the increase in reactive impedance at the antenna feed point with frequency at frequencies higher and lower than the resonant frequency. An antenna exhibits characteristics similar to those exhibited by a lumped resonant circuit and, just as in the lumped resonant circuit, the change in antenna impedance with frequency is minimized if the Q of the system is low. The Q is reduced if the antenna conductors are increased in diameter relative to antenna length. It is also known that the band width, the frequency deviation that can be accommodated without undue increase in reactance, increases as radiation resistance increases.

Unfortunately, practical circumstances result in a decrease rather than an increase in radiation resistance. The reference dipole exhibits exactly 73 ohms radiation resistance only in free space high above a perfect ground. In practice, radiation resistance is decreased by an increase in radiator diameter relative to length, by reflective objects mounted near the antenna, and by a decrease in antenna height below one-quarter wave length, particularly below 5 MHz. It is common practice, when radiation resistance cannot be calculated or otherwise accurately predicted, to assume a radiation resistance of 50 ohms. That assumption having been made, it is convenient to feed the antenna with a 50 ohm coaxial, non-radiating transmission line. It is customary to interconnect the antenna and the transmission line with a transformer called a "balun" arranged to provide a transistion from the balanced antenna to the unbalanced transmission line.

In addition to lowering antenna Q, attempts have been made to increase antenna band width by the incorporation of elements in the antenna system, the function of which is to introduce reactive impedance with frequency change which is the conjugate of the impedance change exhibited by the antenna with that frequency change. To accomplish that result, some attempts have been made to incorporate low Q resonance circuits in the antenna legs.

A variation of that approach is used in the "double bazooka" antenna which was developed as a radar antenna during World War II. The double bazooka is formed by a length of coaxial cable the outer braid of which is severed and separated at the midpoint along its length. The braid at each side of the separation is connected to a respectively associated side of the feed line. At the ends of the coaxial cable, the center conductor and the outer shield braid are connected together. The result is like a folded dipole antenna except that the center conductor does not radiate. The antenna is tuned by the addition of lengths of wire to each end of the coaxial section so that the combination of braid and end section is electrically one-quarter wave length long in air. Each half of the coaxial cable is also one-quarter wave length long electrically, but, because the propogation velocity is less in the coaxial cable, it is physically shorter by the length of the end section. In the true double bazooka, the end sections are formed of open wire transmission line.

The band width limitations of the dipole antenna extend to the Marconi antenna. The Marconi antenna, in most common forms, is an odd number of electrical quarter waves long and is mounted vertically. The earth reflects radio waves in a manner similar to reflection of light by a mirror. In the case of the vertical Marconi antenna, an "image" of the antenna can be considered to exist below ground. The combination of the antenna and its image resemble a dipole except that the contribution of the image portion to radiation resistance measured at the center point of the dipole (base of the Marconi portion) depends upon the conductivity of earth. The analogy to mirror reflection is exact. Just as the mirror can accomplish reflection of three dimensional objects, although it occupies only a plane, so the image antenna is reflected from a plane in the earth. That action can be simulated by electrical conductors extending radially in a plane from the base of a Marconi vertical antenna whether the plane of the radial conductors lies at or above the surface of the earth. The term "ground plane" embraces both the earth and the simulated earth.

If the vertical antenna is one-quarter wave length long, and the ground plane is a perfect conductor, the radiation resistance is half of that of the standard dipole. In practice, perfect conductivity in the ground plane is not achieved, and it is customary in antenna design to assume a ground plane resistance that reduces radiation resistance to 25 ohms which is one-half of what is assumed in dipole design.

DISCLOSURE OF INVENTION

In one of its forms the invention provides a dipole antenna which incorporates two matching stubs, one associated with each leg of the dipole. The stubs introduce reactance to oppose the off-frequency reactance of the dipole antenna. Each stub is formed by a length of coaxial cable whose outer braid constitutes part of the antenna radiator itself. The stubs are one-quarter electrical wave length long, or nearly so, and are shorted at their outer ends. They are connected in parallel with one another and with the antenna by being cross-connected to the feed point. They are selected, in the preferred embodiment, so that they combine with the feed point impedance of the antenna to present to the feed line an impedance which nearly matches line impedance at frequencies midway between the midband frequency and the upper and lower edges of the operating band. In the preferred embodiment, the resistive impedance mismatch between the feed line and the combination of antenna and compensation stubs at band center frequency is approximately equal to the resistive mismatch at the band edges. In practice, an antenna so arranged can be operated at a standing ratio less than two to one with a standing wave ratio change of no more than 0.5 over a band width as much as fifteen to twenty percent of band center frequency. In a preferred arrangement, intended to be fed with a 50 ohm coaxial cable through a balun, with an impedance transformation ratio of one to two, the antenna system presents to the balun a resistive impedance of about 50 ohms (2 to 1 SWR) at midfrequency, and a nearly resistive impedance of about 200 ohms (2 to 1 SWR) at band edges. It presents a complex impedance of about 100 plus or minus j 40 ohms (1.5 to 1 SWR) at the midfrequencies between band center and upper and lower band edge frequencies (see FIGS. 7, 8 and 9).

Antenna system impedances of that order result from an arrangement in which the legs are formed from coaxial cable having an effective surge impedance of about 25 ohms. The coaxial sections are shorted at their outer ends, and each has electrical length of one-quarter wave length. The center conductor of each cable section is connected at the feed point to the braid of the opposite cable section. The radiator itself is formed by the outer braid of the two cable sections and wire end extensions which increase the overall electrical length of the radiator to one-half wave length in air.

Unlike the double bazooka, and other prior broadband systems, the antenna of the invention is not arranged to achieve minimum possible standing wave ratio at band center. Instead, the invention combines a center frequency mismatch comparable to the mismatch at band edges with selection of a cable section in which the reactance tends to cancel antenna reactance at off-resonance frequencies.

In this preferred form, the combined impedance of the antenna and compensation stubs is one-fourth at resonant frequency of the nearly resistive impedance at band edge frequencies, and about one-half of the complex impedance at the upper and lower frequencies midway between resonant frequency and band edge frequencies. The feed line system in the preferred embodiment has an effective characteristic impedance of 100 ohms or twice the value of the combined impedance of the antenna and compensation system at resonant frequency. In a system in which the feed system is formed by a 50 ohm coaxial cable and a balun having a 1 to 2 impedance transformation ratio, the antenna system presents a 50 ohm load at the feed point at resonant frequency. At band edge frequencies that nearly resistive impedance is increased to about 200 ohms, and at the midfrequencies, between resonance and band edges, the complex impedance is about 100 plus or minus j 40 ohms. Those values are achieved by making the stubs of 25 ohm surge impedance cable. Alternatively, cable of higher surge impedance values may be substituted and the required feed point surge impedance reached by the addition of conventional stubs having appropriate characteristic impedance.

Some adjustment in feed point impedance can be made by changing the length of the matching stubs, but the electrical length should not differ from mid-frequency quarter wave length by more than about five percent. Greater deviation results in excessive impedance and attendant SWR at the opposite band edge.

The basic structure of the invention, then, is an antenna leg a portion of which is formed by a two-conductor transmission line one conductor of which is free to radiate and the other of which is not. The transmission line conductors are shorted together at one end of the line whereby the non-radiating conductor combines with the other conductor of the line to form an impedance modifying stub, and said other conductor of the line forms part of the antenna leg. In preferred form, the transmission line exhibits 25 ohms surge impedance and is a coaxial line or cable.

It has been discovered that reflection at the ground plane of the antenna permits extension of the invention to vertical antennae. It has also been discovered that antenna elements constructed according to the invention, and short circuited at one end, will serve as broad band passive radiators —as directors and reflectors in directive antenna systems.

To provide improved and broadband vertical antennae and passive radiators or parasitic elements, and to provide improved directive beam antennae and broadside and colinear and other antennae arrays are other objects of the invention.

DESCRIPTION OF THE PREFERRED EMBODIMENT

Figure 13:
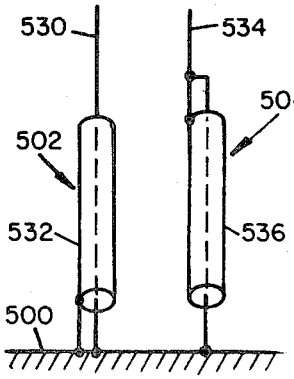
FIG. 13 shows schematic diagrams of Marconi forms of the passive or parasitic radiator elements of the invention.

The preferred forms of the invention employ a radiation element, examples of which are shown in FIG. 13, which is nominally one-quarter wave length long electrically at the design center frequency for operation. That element comprises an extension conductor connected to the outer end of a length of two-conductor transmission line. One conductor of the line does not radiate, and the velocity of current flow in the non-radiating conductor is less than in the other conductor and extension conductor. As a consequence, the element exhibits two electrical lengths, one along the path of the non-radiating conductor and the other along the path formed by the radiating conductor of the line and the extension. Because the velocity constant in the two-conductor line will, in practice, be less than the velocity constant of the outer conductor and extension, the electrical length of the non-radiating conductor will be less than the combined electrical length of the other conductor and the extension. The inner conductor can be made to serve as a non-radiating matching stub for the outer conductor of the element of which it is a part, or of another element.

To simplify understanding, and because it represents a familiar and readily available and practical form of the structure, the term "coaxial cable" will be used herein to mean transmission lines having at least two conductors one of which can radiate and the other of which cannot. Thus, the term describes coaxial line and coaxial cable and certain wave guides and other special forms that function in similar manner. Similarly, in the explanation that follows, the terms "radiator" and "transmitter" will be used in connection with explanations of applications for the invention with the understanding that receiving and receivers and transceivers and the like are also intended because broadbanding of antennae is also important in the reception of signals.

Restated, using the term "coaxial cable," the basic element of the invention is a length of coaxial cable and an extension conductor connected to the outer conductor of the cable. In most applications that element is extended along a straight line because its operation in that configuration is most easily predicted and is most efficient. However, the invention is not limited to straight forms.

The basic element is one-quarter electrical wave length long, but it can be extended to odd multiples of one-quarter wave length. In dipole configurations, two of the basic elements are employed, usually in a straight line or V-shaped configuration.

When the basic element is employed as a radiating or receiving element of an antenna system, energy is fed to it, or derived from it, at the end of the coaxial cable opposite the end at which the extension conductor is connected. In most, but not all, preferred forms, the inner and outer conductors of the line are shorted together at the end at which the extension conductor is connected. In special circumstances in which full length antenna elements cannot be used, the extension conductor may not be connected to the center conductor of the coaxial cable and the short is made at the other end of the line. This causes the element to "look longer" (more inductive) electrically at lower than band-center frequencies, and to "look shorter" (more capacitive) electrically at higher than bandcenter frequencies. In this way, conjugate reactive compensation is achieved for the radiating element over a much wider range of frequencies than can be achieved without compensation.

In the preferred dipole forms of the invention, the coaxial segment of each side of the dipole serves as the stub for the other leg of the dipole. In the Marconi configuration, the coaxial section serves as the stub for the leg of which it forms a part. However, the inner and outer conductors of the coaxial cable may be shorted together at the end opposite the end to which the extension conductor is connected in some applications, including some in which the element is to serve as a parasitic element. That is true even when two elements are arranged end to end to form a dipole parasitic reflector or director. Here, too, the usually preferred form has the inner and outer conductors of the coaxial section shorted at the end to which the extension is connected.

In antenna studies, and in design, it is customary to consider the straight one-half wave dipole antenna to be the standard, and to define other antennae as deviations from that standard. Accordingly, the antenna elements and systems of the invention will be described by comparison with the reference dipole.

Figure 1:
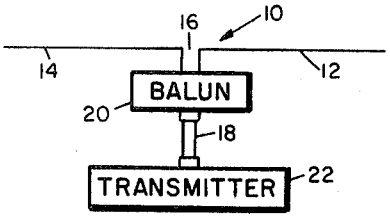
FIG. 1 is a diagram of a reference dipole antenna connected by a balun and coaxial feed line to a radio transmitter.

The reference antenna 10 is shown in diagrammatic form in FIG. 1. It consists of two conductor legs 12 and 14, each one electrical quarter wave long at the operating frequency. The legs are arranged end to end in a straight line and are mounted horizontally in free space or in air one-quarter wave length, or a multiple thereof, above a perfectly conductive ground plane. When constructed of conductors approaching infinitely small diameter, such an antenna exhibits 73 ohms resistive radiation impedance at the center feed point 16. That impedance is exhibited when the antenna is driven at the frequency for which the antenna is one-half electrical wave length long. At other heights, the resistive impedance is above or below 73 ohms. At other frequencies, the antenna exhibits complex impedance. At higher frequency, the impedance has resistive and inductive components, and at lower frequency, the impedance has resistive and capacitive components. At much higher frequencies, where the wave length is relatively short, other special antenna configurations are feasible. At 15 MHz one-quarter wave length is ten meters. As frequency is decreased, wave length increases, and at or below 5 MHz it becomes increasingly difficult to erect the antenna at least one-quarter wave length above ground. In general, radiation resistance is reduced as height is lowered below one-quarter wave length at the frequencies at which dipoles are used. A compromise figure of 50 ohms is more representative, particularly in inverted V form above imperfect conducting ground. In some radio services, it is usual to assume a 50 ohm radiation resistance. That assumption is made in the description of the preferred embodiment that follows. If, in a particular case, the actual radiation resistance is known, the system can be optimized by extrapolation, using the principles and the example set forth below.

Coaxial cable is much more common and much more convenient than open wire transmission line, so a coaxial feed line 18 has been selected for illustration in FIG. 1. It is possible for radiation to occur from the outer conductor of a coaxial line, but not from the inner conductor. For that reason, coaxial cables are called unbalanced lines. The antenna itself is symmetrical, or balanced. It is usual to interconnect the unbalanced feed line with a balanced antenna through a transformer 20 to prevent feed line outer conductor radiation. That transformer can have any turns ratio needed to match the surge or characteristic impedance of the transmission line 18 with the radiation resistance of the antenna. If the radiation resistance is assumed to be 50 ohms, it is convenient to use a balun with a turns ratio of one to one and a coaxial cable which exhibits 50 ohms impedance. The output stage of the transmitter 22 ordinarily includes an impedance matching network by which the impedance of the feed line 18 can be matched to the plate resistance or equivalent impedance of the last stage in the transmitter. The input network of receivers is similar.

The overall length of the radiator is one-half wave length. The velocity of electrical energy in a wire is approximately ninety-five percent of the velocity in a vacuum or free space so that the physical length of the antenna is given by the expression "the velocity of light in meters per second times 0.95, all divided by the operating frequency of the antenna in Hertz."

To permit comparison between the performance of the reference antenna and the antenna systems of the invention, it is assumed that it is desired to operate in the radio amateur service band that extends from 3.5 MHz to 4.0 MHz. Along the abscissa in the graph of FIG. 4, the band center frequency at 3.75 MHz has been labelled $f_0$. The upper and lower band edges at 4.0 MHz and 3.5 MHz have been labelled $f_{HI}$ and $f_{LO}$, respectively. The frequency 3.62 MHz, approximately midway between $f_{LO}$ and $f_0$, is called the midlow frequency and is labelled $f_1$. 3.87 MHz is called the midhigh frequency and is labelled $f_2$. Along the ordinate, the numerals represent standing wave ratios. Ratios from one to three are shown. Many modern commercially available transmitters cannot be operated safely at standing wave ratios exceeding two to one. If the transmitter 22 in FIG. 1 had that limitation, and if the antenna 10 was cut to center frequency $f_0$, it would not be possible to retune the transmitter if its operating frequency were changed from $f_0$ to a value approaching $f_1$ or $f_2$. That is because the standing wave ratio curve for the reference antenna, the curve 28 formed of short dashed lines, rises rapidly above two to one at frequencies approaching $f_1$ and at frequencies approaching $f_2$. In practice, to ensure optimum operation, the transmitter output would be retuned at even lesser frequency excursions from $f_0$.

Figure 4:
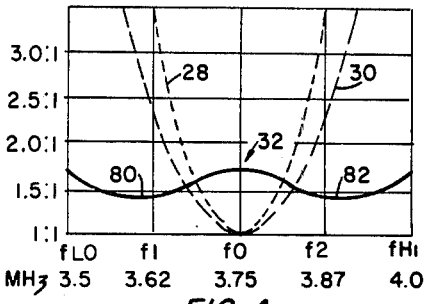
FIG. 4 is a graph in which the relationship of standing wave ratio to frequency for systems according to the invention are compared with that of prior art systems.

The curve 30 formed of long dashes in FIG. 4 represents the standing wave ratio curve that can be expected with the double bazooka antenna. It is more shallow than curve 28, but rises above a standing wave ratio of two to one before reaching the band edges. Consequently, the transmitter 22 could be operated safely into a double bazooka antenna across a wider but still insufficient portion of the 3.5 MHz to 4.0 MHz band without retuning. Also, the change in the standing wave ratio over the band width is greater than 1.0, so that much reloading is still required if optimum efficiency and minimum heating is to be achieved. That difficulty is overcome in an antenna which exhibits standing wave ratio variation of the form depicted by curve 32. Curve 32 describes the kind of standing wave ratio uniformity that can be achieved over a service band using an antenna according to the invention. It is, in fact, a description of the standing wave ratio that is achieved in the system depicted in FIG. 2. The FIG. 2 system includes two compensation stubs, 40 at the right and 42 at the left. At their inner ends, those stubs are cross-connected to a balun transformer generally designated 44. At its outer end, the stub 40 has its center conductor and braid interconnected by a conductor 46, and the two are connected to a wire end extension 48.

At its outer end, the stub 42 has its braid connected to the center conductor by a connector 50. The braid and center connector are connected to a wire end extension 52. The radiating portion of the antenna is formed by two legs each one-quarter electrical wave length long in air. One leg is formed by the combination of end wire extension 52 and the outer conductor or braid of stub 42. The other leg is formed by the combination of end wire extension 48 and the outer conductor or braid of compensation stub 40.

In this embodiment, the stub 40 and the stub 42 are lengths of coaxial cable having a surge impedance of 25 ohms. The center conductor of stub 40 is connected by a conductor 56 to terminal 58 of the balun 44. Terminal 58 is also connected to the outer conductor of stub 42. The inner conductor of stub 42 is connected by a line 60 to terminal 62 of the balun 44 which terminal is also connected to the outer conductor, the braid, of stub 40. Terminals 58 and 62 of the balun are interconnected by windings 64 and 66 of the balun. The terminals 58 and 62 are the output terminals of the balun. One is connected to the leg formed by extension 52 and the outer conductor of stub 42. That one is connected to terminal 58. Terminal 62 is connected to the radiating leg formed by the outer conductor of stub 40 and extension 48.

In the equivalent circuit, the radiating legs of the antennae are represented by a feed point impedance which is connected across secondary terminals 58 and 62. The stubs 40 and 42 are connected in parallel with one another across those same secondary terminals. Thus, in the equivalent circuit, the feed point impedance of the radiator and the impedance of the stub 40 and the impedance of the stub 42 are all connected in parallel with one another across the secondary terminals 58 and 62 which can be called the feed point for the antenna system.

In this embodiment, the combined length of the outer conductor of stub 40 and extension 48 are one-quarter wave length long electrically in air at frequency $f_0$. Similarly, the combined electrical length of the outer conductor of stub 42 and extension 52 is one-quarter wave length in air at frequency $f_0$. The physical length of each of those two lengths is approximately ninety-five percent of a quarter wave length in free space. Each of the stubs 40 and 42 is also one electrical quarter wave length long at frequency $f_0$. The velocity constant for representative coaxial cable is sixty-six percent of the velocity in free space. Thus, the physical length of the stubs 40 and 42 is less than the physical length of the radiating legs, notwithstanding that their electrical lengths are essentially equal. If it is assumed that the antenna is mounted at less than one-quarter wave length above earth ground, the radiator impedance will be resistive and have a value of about 50 ohms. It is less than the theoretical value of 73 ohms because of the larger conductor diameter and nearness or proximity to earth ground. Twenty-five ohms, and 25 ohms, connected in parallel, is equivalent to 12.5 ohms, and that is the equivalent compensating surge impedance presented to the antenna feed point. However, the feed point impedance of the antenna system remains essentially 50 ohms at $f_0$.

Figure 2:
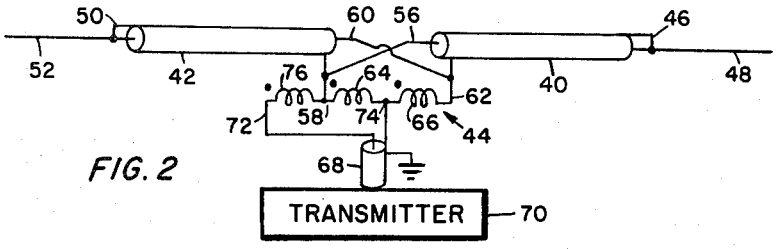
FIG. 2 is a diagram of an antenna system incorporating the invention.

Because of its ready availability, relatively low cost, and because it matches the output circuits of most commercial transmitters, receivers or transceivers, the feed line employs a 50 ohm coaxial cable which is shown in FIG. 2 and identified by the reference numeral 68. It is not required in the invention that that line have any prescribed operational length. The balun 44 has a turns ratio that will limit the maximum mismatch between the impedance of the antenna system and the surge impedance of the coaxial feed line to a ratio of less than 2 to 1, and the feed line 68 need not be a multiple of half wave lengths long, except for purposes of accurately measuring feed point SWR at the transmitter output with conventional apparatus, but can have any length. Most transmitters have output circuit adjustability to accommodate that small degree of mismatch. The transmitter 70 of FIG. 2 has that kind of adjustability.

The input terminals of the balun are numbered 72 and 74, respectively. Terminal 74 is connected to the junction of balun windings 64 and 66 and to earth ground. Input terminal 72 is at the end of a third balun winding 76 whose other end is connected to terminal 58. Thus, windings 64 and 76 constitute the primary windings of the balun, and the combination of windings 64 and 66 constitute the secondary circuit of the balun. In preferred form, the three windings are trifilar windings on a toroidal core. The black dot on each winding indicates magnetic polarity according to established conventions.

In this embodiment, the turns ratio between primary and secondary is selected such that the impedance of the antenna system appears to be about 25 ohms from the primary side of the balun at $f_0$, and so that the impedance of the feed line 68 appears to be about 100 ohms when looking from the secondary side of the balun at $f_0$. Thus, in this preferred embodiment, the impedance transformation ratio across the transformer is essentially 2 to 1. In that circumstance, the standing wave ratio in the feed line 68 is approximately 2 to 1 at $f_0$. That figure is improved as the radiation resistance of the antenna is increased in operating excursions from $f_0$ toward $f_1$ and $f_2$, to approximately 1.5 to 1. Excursions in operating frequency beyond $f_1$ and $f_2$ degrades SWR which approaches 2 to 1 again at band edge frequencies of $f_{LO}$ and $f_{HI}$.

Figure 5:
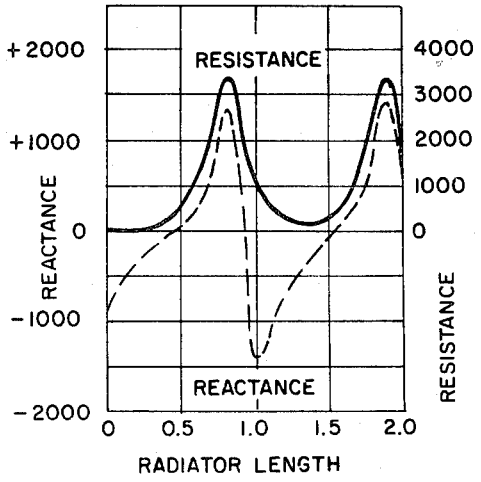
FIG. 5 is a graph of the changes in standard dipole antenna resistive and reactive impedance with antenna length.

FIG. 5 is a graph on which is plotted the variation in resistive impedance and reactance impedance that appears across a reference dipole antenna in which the ratio of conductor length to conductor diameter is about 1000. At a half wave length, the reactance is near zero. It becomes positive or inductive at longer wave lengths or higher frequencies. The reactance becomes negative or capacitive at shorter wave lengths or lower frequencies. The graph also shows that the resistive component of feed point impedance increases as wave length is increased or frequency is increased, whereas the feed point resistance is reduced somewhat at shorter wave lengths or lower frequencies. That suggests that the standing wave ratio will be slightly different at frequencies below mid-frequency than it is at frequencies above mid-frequency, and, indeed, that is reflected in the shape of the curve 32 in FIG. 4 where the region 80 describes a slightly different standing wave ratio than does region 82 above mid-frequency.

Figure 7:
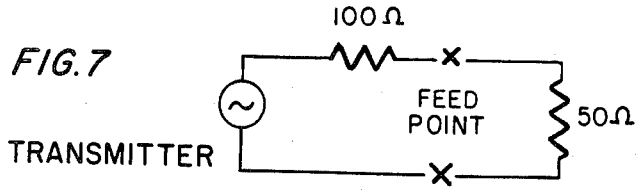
FIGS. 7, 8 and 9 are diagrams of the antenna system of the invention referred to the antenna side of the balun transformer showing the equivalent circuits at frequencies $f_0$, $f_1$ and $f_2$, and $f_{LO}$ and $f_{HI}$, respectively.
Figure 8:
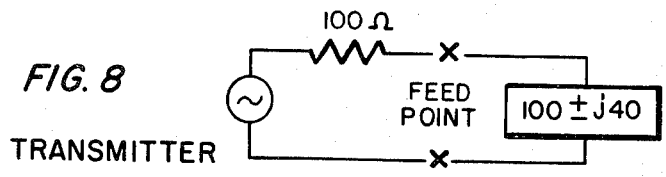
Figure 9:
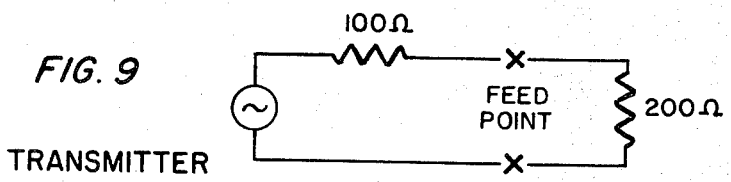

No graph is shown of the impedance variation with length, or frequency, of the compensation stubs, but the variation of their impedance will be substantially the inverse of the reactance curve of the antenna. The equivalent circuits at key frequencies shown in FIG. 4 are indicated in FIGS. 7, 8 and 9. Thus, the reactive component of radiator impedance at off-center frequencies tends to be cancelled by the reactive impedance of the compensation stubs at off-center frequencies. The fact that the reactance curve shape in the range of $f_{LO}$ to $f_{HI}$ is not exactly the inverse of the compensation stub reactance means that complete cancellation can occur at only one set of frequencies. It is preferred to make the compensation stubs of coaxial cable having a surge impedance of 25 ohms because the reactance curve for their 12.5 ohms equivalent places the reactance cancellation points at frequencies that differ from mid-frequency by plus and minus 6 to 7 percent of mid-frequency, as shown in FIG. 4 near $f_{LO}$ and $f_{HI}$ band edges.

The resistive feed point impedance at frequencies six to seven percent above and below resonant frequency is near four times the resistive impedance at resonant frequency. That number varies, as does radiation resistance, with antenna height, radiator diameter, and, to some extent, with ground conductivity. The cable surge impedance and turns ratio in the balun that are described as preferred in the embodiment of FIG. 2 assume a band edge resistive impedance of about 200 ohms. Looking from the primary side of the balun, that impedance looks like about 100 ohms which is twice the surge impedance of transmission line 68 so that the standing wave ratio at band edges is again essentially 2.0 to 1.

Figure 3:
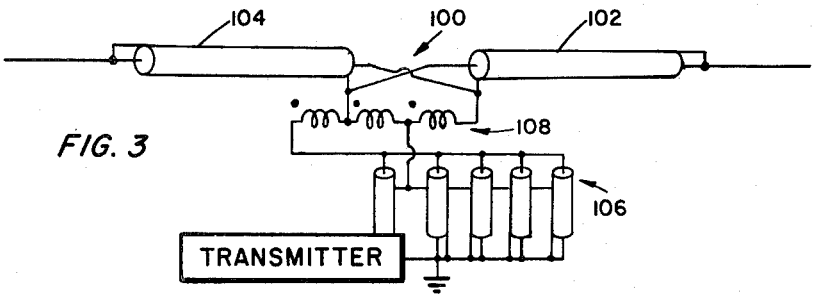
FIG. 3 is a diagram of a modification of the antenna system of FIG. 2.

The system 100, shown in FIG. 3, employs an antenna system like that of FIG. 2 except that, in this case, the stubs 102 and 104 are formed of coaxial cable whose stub surge impedance is 50 ohms. In parallel, they present a 25 ohm surge impedance stub across the feed point of the antenna system. That value is effectively reduced by the inclusion of a third set of 50 ohm stubs 106. The equivalent surge impedance of these 50 ohm stubs is 12.5 ohms on the primary side of the balun 108.

Referring to the feed point on the secondary side of the balun 108, with surge or characteristic impedance of 25 ohms, the added stubs would reduce the combined feed point effective stub surge impedance to essentially 12.5 ohms. However, in this circuit, for practical reasons, it is connected on the primary side of the transformer 108 which is assumed to have an impedance transformation ratio of 1 to 2. Therefore, so that it will have the same electrical effect as a 25 ohm stub on the secondary side of the transformer, the stubs 106 are constructed of four 50 ohm coaxial cables in parallel on the primary side of the balun.

Figure 6:
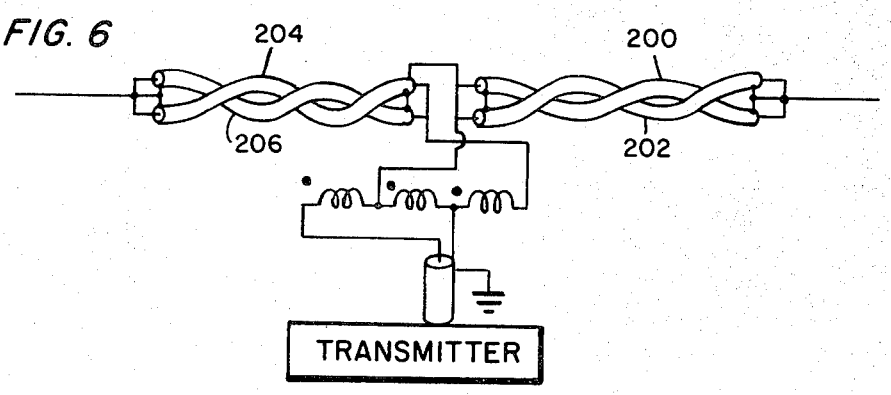
FIG. 6 is a diagram of a second modification of the antenna system of FIG. 2.

The antenna of FIG. 3 is cumbersome in its construction and will perform somewhat differently than does the antenna of FIG. 2, primarily due to increases in antenna system losses due to the use of four stubs 106 connected across the primary side of the balun to achieve the 12.5 ohm equivalent compensation surge impedance across the antenna feed point. Performance of the two systems can be brought more into conformity by omitting the stubs 106 and substituting for them a third stub of 50 ohm cable in parallel with stub 102, and a fourth stub of 50 ohm cable in parallel with stub 104 as shown in FIG. 6. While this variation reduces system losses, the embodiment of FIG. 2 is preferred due to constructional simplicity and less tendency to sag because it is less heavy. FIG. 6 has been included to show that the required compensating stub impedance can be achieved by connecting several stubs in parallel. In this case, two 50 ohm stubs 200 and 202 are connected in parallel to replace a single 25 ohm stub. Similarly, stubs 204 and 206 are made of 50 ohm cable and they replace a single 25 ohm stub.

In the explanation above, it has been assumed that the electrical length of the stubs is the same as the electrical length of the radiating legs. That is not essential to successful operation of the antenna; although the average standing wave ratio across the band will be increased somewhat, it is possible to flatten the standing wave ratio curve across one-half of the service band by cutting the stubs to an electrical length which differs in small degree from the electrical length of the radiators whereby to add capacitive or inductive reactance to feed point impedance at center frequency. In practice, the electrical length should not be changed by more than about five percent of center frequency wave length because greater differential will result in excessive standing wave ratios at opposite band edges and changes with antenna environmental differences that are difficult to predict.

The equivalent electrical operation of the preferred antenna is described in the equivalent diagrams of FIGS. 7, 8 and 9. In each case, the impedances are referred to the secondary side of the balun to permit omission of the balun. FIG. 7 illustrates operation at frequency $f_0$. FIG. 8 illustrates operation at $f_1$ and $f_2$, and FIG. 9 illustrates operation at $f_{LO}$ and $f_{HI}$. The standing wave ratio is approximately 2 to 1 in the case of FIGS. 7 and 9, and is approximately 1.5 to 1 in the case of FIG. 8.

Figure 10:
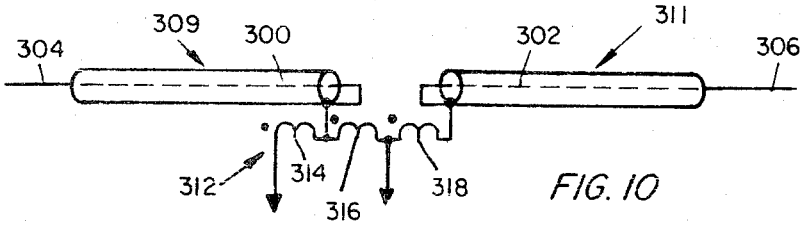
FIG. 10 is a schematic diagram of a modified dipole antenna system according to the invention.

Manufacture of antenna in accordance with the invention is not difficult. In practice, the stubs are cut to a length that represents one-quarter electrical wave length of what is to be the center operating frequency of the antenna. The end extensions are made longer than required to make the radiating legs approximately one electrical quarter wave length long at that frequency. The antenna is then installed in that form, and standing wave ratio measurements are made to determine its performance in the actual environment in which the antenna will remain. If the graph of standing wave ratio with frequency has a center hump, that suggests that the radiation resistance of the antenna should be adjusted, the height can be adjusted up or down and/or the ends of the dipole can be lowered or raised in inverted V form. Accordingly, the measured standing wave ratio variation is excessive, and if the center hump in the curve does not occur at midfrequency, that can be corrected by symmetrically adjusting the length of the end wire extensions. Thus it is that the process for adjusting and tuning antennae, according to the invention, is substantially the same as the process used for adjusting and tuning the standard dipole antennae. It is preferred, because the operation of the two legs of the dipole is thus made more uniform, that the coaxial line of each leg serve as the reactance modifying stub for the other. However, that is not essential. It has been discovered that the coaxial line can serve as the matching stub for its own leg. That can be done in either of two ways. In the first, the reactive impedance of the stubs is achieved by removing the short circuit at the outer end of the coaxial cable section and shorting the inner and outer conductors of the cables at the inner end as shown in FIG. 10. In that figure, the inner conductors 300 and 302 have been represented by dashed lines to show that end extension conductors 304 and 306 are connected to the conductors 300 and 302 at the outer ends of cables 309 and 311, respectively. The balun or matching transformer 312 comprises three windings 314, 316 and 318 magnetically coupled as indicated by the black dot convention. The inner and outer conductors at the inner end of cable 309 are connected to the transformer at a secondary terminal between coils 314 and 316. The two conductors of cable 311 are shorted at the inner end and connected to the secondary terminal at the outer end of the balun winding 318. The input terminals are located at the outer end of coil 314 and at the junction of coils 316 and 318. The circuit configuration of FIG. 10 differs from that of FIG. 2 in the position of the short circuits and in the fact that the center conductors are not cross-connected across the secondary winding of the balun transformer. The stubs and antennae are connected in series in the circuit configuration of FIG. 10.

Figure 11:
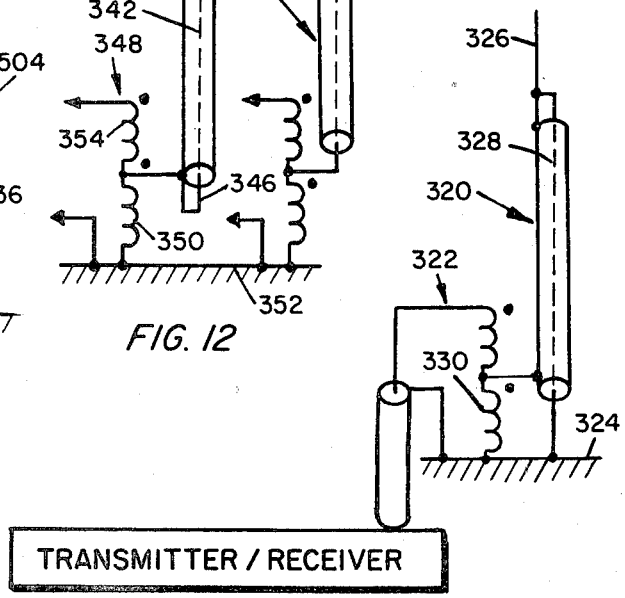
FIG. 11 is a schematic diagram of a Marconi type antenna system according to the inven- tion.

The second scheme for making each coaxial cable serve as the stub for the leg of which it is a part is illustrated in FIGS. 11 through 14. The antenna system of FIG. 11 is derived from the arrangement of FIG. 2. It is equivalent to half of the antenna system of FIG. 2. Physically and electrically, only one leg 320 and half of an output side 330 of a balun transformer, like the one shown in FIG. 2, are employed. To complete the system, the balun output is connected across the two coaxial cable conductors at the inner end of the cable. One side of this connection, the center conductor side in this example, is connected to a ground plane 324. Doing that will supply the ground plane "image" to form a Marconi type antenna. It is not essential, but in practice such an antenna is usually mounted vertically.

Figure 12:
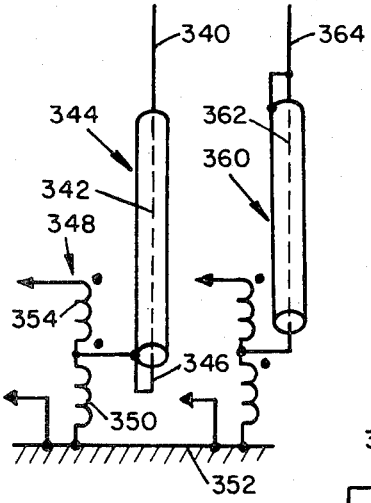
FIG. 12 is a schematic diagram of two modified Marconi type antenna systems according to the invention.

Another form of Marconi antenna is shown in FIG. 12. As in the case of the dipole, or Hertzian, antenna of FIG. 10, the reactance of the stub was achieved by removing the short circuit from the outer end of the coaxial cable stub and short circuiting the inner end of the cable section instead. As in the case of FIG. 10, the center conductor and outer conductor at the inner end of the coaxial section are connected to one output terminal of the balun and the other output terminal of the balun is connected to what corresponds to the other leg of the antenna. In FIG. 12, the extension conductor 340 is connected to the outer end of the conductor 342 of cable section 344. The two cable conductors are connected together at the cable's inner end by a short circuit 346. The short is connected to one output terminal of balun 348 at the junction between the two coils of the balun. The other output terminal of the balun at the other end of the coil 350 and one input terminal are connected to the ground plane 352. The other input terminal is connected to the other end of balun coil 354.

The invention requires that the stub exhibit reactance opposing the reactance exhibited by the antenna leg with which it is associated. That effect can be achieved by arranging for current flow in opposite directions in the leg and stub as in FIGS. 2 and 11, or by reversing stub configuration between shorted circuit termination to open circuit termination, as in FIGS. 10 and 12.

In FIG. 11, current flows down in the center conductor of the coaxial cable, through the lower section of coil 322 and then up in the antenna leg for one-half cycle. For the following half cycle, current flows down in the antenna leg and upward in the cable's center conductor. Thus it is that current flow in leg and the short circuited stub are always opposite and reactances are opposed. In FIGS. 10 and 12, current flow in the leg and the stub are in like direction. To achieve the reactance of the stub, the stub short at the end opposite the driven end is removed to provide an open circuit.

Figure 14:
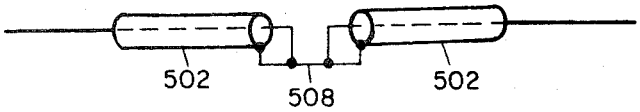
FIGS. 14. 15 and 16 are schematic diagrams of dipole forms of the passive or parasitic radiator elements of the invention.
Figure 15:
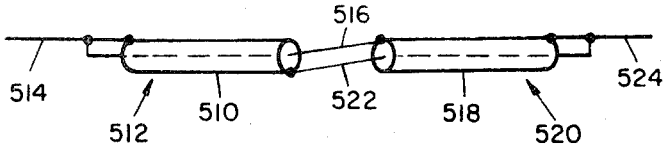

Antenna elements to which energy is supplied by a transmitter or from which energy is removed as by a receiver are called active or driven elements. Thus, the legs of the antenna systems in FIGS. 1, 2, 3, 6, 10, 11 and 12 are driven elements. The legs or elements shown in FIGS. 13, 14 and 15 are passive or parasitic elements. They are not connected to an energy source or load, but, when placed in a field of radio waves, energy from the field is induced in the passive element causing current flow in the passive element. If the element is an odd multiple of one-quarter electrical wave lengths long, if the element is resonant at the frequency of the radio energy, standing waves of voltage and current are developed and the energy that was absorbed is radiated away. Termed parasitic, such elements are employed in directive arrays. They are placed in parallel with, and in juxtaposition to, the driven element or elements. The spacing between parasitic and driven elements determines whether the parasitic element will serve to aid or oppose radiation from the driven element. If re-radiation from the parasitic element tends to cancel radiation from the driven element, the parasitic element is called a reflector. If re-radiation reinforces the driven element output, the parasitic element is called a director. If the driven and parasitic elements are arranged in a plane with reflectors on one side of the driven element and directors on the other side, more of the output energy from the driven element will be directed in the direction of the plane on the side toward the directors than will be radiated in other directions. Antenna systems of that kind are called beams. If two or more beams are arranged in a common plane in juxtaposition so that they are directive in the same direction, they are called a colinear array. If they are juxtaposed in parallel planes and are directive in like direction, they are called a stacked array.

A number of juxtaposed driven elements arranged in a plane are called a broadside array when spaced and phased to cancel the radiation of adjacent elements, and are called an endfire array when spaced and phased to reinforce the radiation of adjacent elements.

Figure 17:
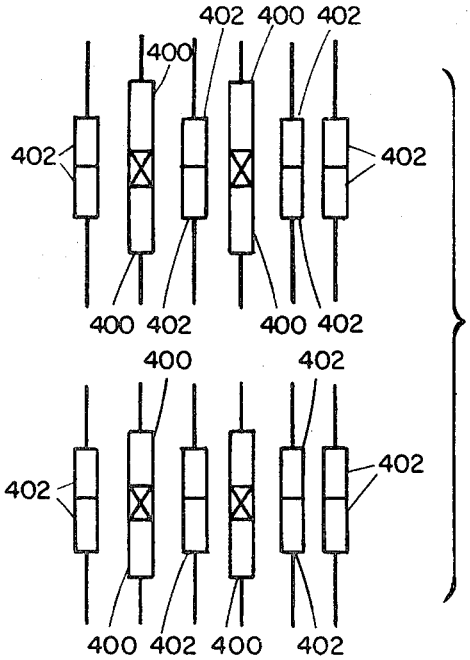
FIG. 17 is a schematic diagram of an antenna array employing dipole radiators and dipole parasitic radiators.
Figure 18:
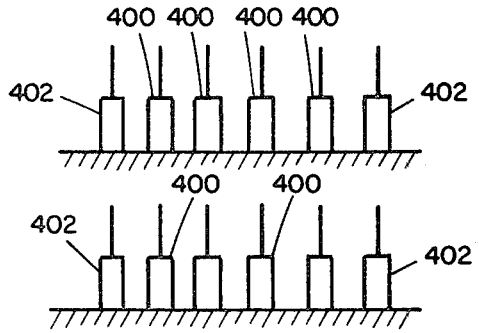
FIG. 18 is a schematic diagram of an antenna array employing Marconi type radiators and Marconi type parasitic elements.

The arrangement, phasing and spacing, and design of feed systems for beams and arrays using dipole or Hertzian and Marconi or monopole elements is well known. That technology is applicable without modification to the invention. The broadband driven elements and broadband parasitic elements of the invention can be employed as direct replacements for the conventiona elements of prior beams and arrays. That is illustrated in FIGS. 17 and 18. FIG. 17 depicts a colinear array formed by two beams each of which includes four driven elements arranged as two dipoles, and eight parasitic elements arranged as one dipole reflector and three dipole directors. The array of FIG. 18 is forced by a parallel two-section, Marconi broadside array each section of which is formed by four sets of juxtaposed driven elements. In each section, the driven elements are spaced to cancel radiation of the next element. The two sections are spaced so that radiation in the broadside direction is reinforced. A parasitic reflector at each end of each section tends to cancel end fire radiation from the section. The symbol numbered 400 in FIGS. 17 and 18 represent any drive element of the kind shown among FIGS. 2, 3, 6, 10 and 11. The symbol 402 in FIGS. 17 and 18 represent any parasitic element of the kind shown in FIGS. 13, 14 and 15 of the drawing.

If the driven elements of FIGS. 11 and 12 were disposed in a field of radio energy having a wave length four times as long as their electrical length, energy would be induced in each of the two elements. Current will flow first in one direction, and then the other, in the "leg" formed by extension conductor 326 and the outer conductor 328 of coaxial line 320 in FIG. 11. Because that leg is one-quarter wave length as long as the energy of the field, the current and voltage distribution will be just what it would be if, instead of the field, the element had been energized at winding 330 of balun 322. Moreover, that energy represented by current flow in the leg (and the voltage field of the leg) is re-radiated just as if the leg had been energized at coil 330. The efficiency of re-radiation can be increased by short circuiting the coil 330. If the coil is shorted so that the outer conductor is connected directly to the ground plane 324, the inner and outer conductors at the inner end of coaxial line 320 will be shorted. In that circumstance, the line will be shorted at both ends and the coaxial line will not be effective as an impedance modifier. However, if the short is removed from one end or the other of the line, it will be effective. As voltage and current change in the outer conductor of the line, the electrical stress, the voltage gradient across the dielective of the line, is changed. As an incident to that stress, current is caused to flow in the center conductor and that flow is in a direction opposite to flow in the outer conductor.

There will be reflections at the ends of the inner conductor and a phase difference between current and voltage maximums. The degree of difference depends on the electrical length of the coaxial line whereby the line will serve as an impedance modifying stub just as it does when the element is excited from a transmitter source.

The antenna element of FIG. 11 in parasitic form is shown in two forms in FIG. 13. The balun has been omitted and the coaxial line's inner conductor is connected to ground plane 500 in both forms. Element 502 has the line conductors shorted at the inner end of the line, and element 504 has the line conductors shorted at the outer end of the line.

These same two forms of parasitic elements are shown in dipole configuration in FIGS. 14 and 15. In FIG. 14, two elements, like element 502 of FIG. 13, are arranged on a common line with the inner end of one connected to the inner end of the other. Instead of being connected to a ground plane, the short circuit at the inner end of each coaxial line is connected to the short circuit of the other by a conductor 508. That conductor 508 may be connected to the ground plane if desired, and that has an advantage in the construction of a beam antenna. There is no need to insulate the inner ends of the elements from the boom on which the elements are mounted if the boom is made of metal and is grounded.

The parasitic dipole of FIG. 15 is derived from the form of the element 504 in FIG. 13 and from the interconnection arrangement of FIG. 2. Here, two elements similar to element 504 of FIG. 13 are arranged in dipole form. The outer conductor 510 of element 52 is connected to extension conductor 514 and to the inner conductor of the coaxial line at the outer end of the line. At the inner end of the line, the center conductor is connected by conductor 516 to the outer conductor 518 of the coaxial line of element 520. The outer conductor 510 of the element 512 is connected by a conductor 522 to the center conductor of the coaxial line of element 520. That center conductor is shorted to outer conductor 518 and extension conductor 524 at the outer end of the coaxial line of element 520. In FIG. 15, the coaxial line of element 520 serves as the stub for element 512, and the coaxial line of element 512 serves as the stub for element 520.

A major advantage of the invention is that the relative impedance of the primary leg and of the stub may be altered merely by changing the relative length of the extension conductor and the coaxial transmission line. Reversing the position of the short circuit extends the range of relative impedance difference that is possible by changing relative length, and the boundaries of the range can be adjusted by selection of the transmission line surge impedance.

The length of the transmission line portion, and of the extension conductor portions of these several active and parasitic antenna elements, are selected according to the principles explained in connection with the development above of the elements of FIG. 2.

In that development, it was shown that the preferred elements employed 25 ohm coaxial line. The preferred embodiments of the remaining figures also are formed using 25 ohm lines unless otherwise noted.

The effect of the stub is to introduce reactance to the antenna leg circuit. That can be envisioned as a change in electrical length of the antenna leg. It matters not when changing electrical length whether the lengthening and shortening occurs at one end or the other, or in the middle of the leg. Therefore, it is permissible to alter the point at which the impedance control stub is connected to the antenna leg. Thus, in FIG. 13, element 504 has its end extension 530 connected to the center conductor of line 532 at the outer end of the line, and the line conductors are shorted at the inner end. The other element 504 has its extension conductor 534 connected to the outer conductor of line 536 at the outer end of the line and the line conductors are shorted at their outer end. The part of the antenna leg formed by the stub experiences current flow which can be characterized as the composite of antenna current and stub current. The antenna current in both of these FIG. 13 configurations flows in the outer, radiating conductor of the line, and in the extension conductor. The stub current flows in the two conductors of the transmission line. The equivalent circuits of these two elements differ only in that in the case of element 502, the stub appears at an intermediate point in the line, whereas in the case of element 504, the stub appears at the inner end of the line.

To emphasize and illustrate that point, element 360 has been added in FIG. 12. The outer end of its line 362 is shorted and connected to the end extension 364. Comparison of FIGS. 11 and 12 shows that the same configuration, element 320 in FIG. 11 and element 360 in FIG. 12, can be driven by connecting either the inner or outer conductor of the line to the energy source.

Figure 19:
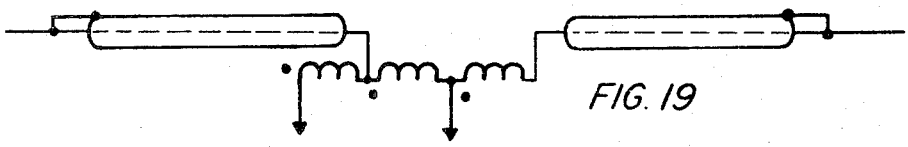
FIG. 19 is a schematic diagram of a variation of the antenna shown in FIG. 10.

The two elements of FIG. 12 are duplicated and arranged in line with their inner ends in proximity in FIGS. 10 and 19 to form dipoles to illustrate that element 344 can be used in a dipole as in FIG. 10, and that element 360 can be used in a dipole as in FIG. 19.

Figure 16:
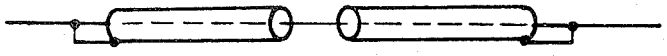

The two passive elements of FIG. 13 are duplicated in FIGS. 14 and 16, and arranged in line with their inner ends in proximity to show that both element forms can be used in a dipole arrangement.

An important modification of the invention is to incorporate a reactor, either an inductor or a capacitor, in the end extension portion of the antenna or parasitic element to alter its physical length without altering its electrical length. It is intended that the antenna and parasitic element forms, with and without such modifications, are represented by the symbols used in the drawings to represent antenna and parasitic elements. Inclusion of capacitive reactance is useful in the case of vertical elements to permit lowering of the physical height. Inclusion of inductive reactance, in the form of a loading coil, is useful in the case of horizontal antennae to permit shorter physical length.

Although I have shown and described certain specific embodiments of my invention, I am fully aware that many modifications thereof are possible. My invention, therefore, is not to be restricted except insofar as is necessitated by the prior art.

I claim:

1. A broadband, dipole antenna in which each leg comprises the radiating conductor of a length of transmission line which line comprises a radiating and a non-radiating conductor joined at an interconnection at their outer ends, and an extension conductor connected to said interconnection; and a pair of stubs connected in parallel with one another across the inner ends of said legs, each stub being formed by one of said lengths of transmission line.

2. The invention defined in claim 1 in which said legs have substantially the same electrical length and in which said transmission lines have substantially the same electrical length.

3. The invention defined in claim 2 in which the stubs are connected across the inner ends of said legs such that the non-radiating conductor of each stub is connected to the radiating conductor of the other stub.

4. The invention defined in claim 2 in which said transmission lines are lengths of coaxial cables.

5. The invention defined in claim 4 in which said transmission lines are lengths of coaxial cable the surge impedance of which is in the range of 24 to 32 ohms.

6. The invention defined in claim 4 in which the equivalent stub surge impedance appearing across the inner ends of said legs is in the range of 12 to 16 ohms.

7. The invention defined in claim 2 in which the electrical length of the stubs differs in an amount less than five percent from the electrical length of the legs.

8. The invention defined in claim 7 which further comprises a balun and a third stub, neither conductor of which third stub forms a part of said legs, the conductors of said third stub being connected at one end across the primary terminals of said balun and shorted and grounded at a distance from the connection to said legs which is substantially equal in electrical length to the electrical length of said legs.

9. The invention defined in claim 8 which further comprises a balun transformer the secondary terminals of which are connected across the inner ends of said legs, and the primary terminals of which are connected to respectively associated ones of the conductors of said third stub.

10. The invention defined in claim 7 which further comprises a feedline system connected across the inner ends of said legs and having an equivalent characteristic impedance approximately twice the resistive impedance of the antenna feed point at the frequency for which the electrical length of said legs is one-quarter wave length.

11. The invention defined in claim 10 in which said feed line comprises a balun and a transmission line the surge impedance of which line, when seen from the antenna side of the balun, is approximately two times said resistive impedance of the said legs at the frequency for which the legs are one-quarter wave length.

12. The invention defined in claim 11 in which said transmission line has a surge impedance of 50 ohms and in which the impedance transformation ratio of said balun is approximately one to two.

13. The invention defined in claim 12 in which each of said stubs is a length of coaxial cable having a surge impedance approaching 25 ohms.

14. An antenna system comprising:

a dipole antenna the electrical length of each of whose legs corresponds to one-quarter of the wave length at a selected frequency; and a pair of compensation stubs in the form of shorted coaxial transmission lines substantially one-quarter wave length long electrically at said selected frequency, each of said stubs having as its outer conductor a portion of the length of a respectively associated one of the legs of said antenna, and having its center conductor connected to the inner end of the other of the legs of said antenna.

15. The invention defined in claim 14 in which each of said stubs exhibits a reactive impedance, at upper and lower frequencies which are a like percentage above and below said selected frequency, which is substantially the conjugate of the reactive impedance exhibited by the antenna legs at said upper and lower wave length, respectively.

16. The invention defined in claim 15 in which the impedance across the inner ends of said antenna legs at said selected frequency is approximately half of the impedance value at said upper and lower frequencies and in which the impedance at frequencies twice said given percentage above and below said selected frequency is approximately four times the impedance at said selected frequency.

17. The invention defined in claim 16 which further comprises a feed line system connected across the inner ends of said antenna legs the characteristic impedance of which is approximately twice the value of the impedance appearing across the inner ends of said legs at said selected frequency.

18. The invention defined in claim 1 in which each of said stubs is itself formed of a plurality of stubs connected in parallel with one another.

19. The invention defined in claim 1 in which at least one of said stubs is formed by a plurality of stubs connected in parallel with one another.

20. An antenna element capable of serving as a leg in an antenna system and as a matching stub for such a leg, said element comprising a length of two-conductor transmission line having an inner end and an outer end and being of a type in which a first one of said two conductors is capable of radiating energy and the second one of said two conductors is not capable of radiating energy, and an extension conductor connected to the second one of said two conductors at the outer end of said line; and said transmission line having a length and a characteristic impedance such as to have an electrical length at a given frequency which is approximately equal to the electrical length at said given frequency of the combination of said first conductor and said extension conductor.

21. The invention defined in claim 20 in which the conductors of the two-conductor line are short circuited at one end of said line.

22. The invention defined in claim 20 in which the two conductors of the line are short circuited at the inner end of the transmission line whereby said element constitutes a parasitic radiator when placed in the field of an antenna which radiates energy at a frequency at which said element will resonate.

23. The invention defined in claim 20 in which the two conductors of the line are short circuited at the outer end of the transmission line whereby said element constitutes a parasitic radiator when placed in the field of an antenna which radiates energy at a frequency at which said element will resonate.

24. The invention defined in claim 20 which comprises a second, like antenna element and in which said elements are placed such that the inner end of the transmission line of each element is proximate to the inner end of the transmission line of the other.

25. The invention defined in claim 24 in which the transmission line of each of said elements has its respective first and second conductors short circuited at one end of the line.

26. The invention defined in claim 21 which comprises a second, like antenna element and in which said elements are disposed substantially in juxtaposition on respectively associated ones of a set of spaced substantially parallel lines.

27. The invention defined in claim 26 in which said transmission line of each of said antenna elements has a length and a characteristic impedance such as to have an electrical length approximating one-quarter wave length at the frequency at which the combination of the respectively associated first conductor and extension conductor of said transmission lines has an electrical length approximating one-quarter wave length at said frequency.

28. The invention defined in claim 26 in which the conductors of the transmission line of each one of said elements are short circuited at the inner end of the line, respectively.

29. The invention defined in claim 26 in which the conductors at the outer end of the transmission line of each of said elements are short circuited to one another.

30. The invention defined in claim 25 which further comprises feed line connection means for interconnecting at least one of said elements to a two-conductor feed line, said feed line means comprising a transformer the secondary side of which is connected across the first and second conductors at the inner end of the transmission line of at least one of said elements.

31. The invention defined in claim 21 which further comprises grounding means for completing a connection to a ground plane and in which said secondary side of the transformer and one of said first and second conductors of the transmission line across which the secondary side of said transformer are connected together to said grounding means.

32. In an antenna array:

first and second antenna elements each comprising a length of coaxial line and an extension conductor connected to the inner conductor of said line at the outer end of the line, the coaxial line of each element being short circuited at one end of the line;

said elements being disposed in a plane in parallel with inner and outer ends of each in juxtaposition, respectively, to the inner and outer ends of the other;

said coaxial line of each element having a length and a characteristic impedance such as to have a characteristic impedance at a given frequency which is approximately equal to the electrical length at said given frequency of the combination of said first conductor and said extension conductor.

33. The antenna array of claim 32 in which at least one of said elements has the conductors of its coaxial line short circuited at the one end of the line and which further comprises means for connecting a source of radio energy to the conductors of the line at the inner end of said line.

34. The invention defined in claim 33 in which the coaxial cable of each element exhibits 25 ohms surge impedance.

35. The invention defined in claim 32 which further comprises a third antenna element like said first element and a fourth element like said second element, said third and fourth elements being disposed with their inner ends proximate to the inner ends of said first and second elements, respectively, and extending in a direction substantially opposite to the direction in which said first and second elements extend, respectively, whereby the first and third elements form one pair of elements and said second and fourth elements form a second pair of elements.

36. The invention defined in claim 35 which further comprises means for connecting the inner and outer conductors of the coaxial lines of at least one of said pairs of elements across a source of radio frequency electrical energy.

37. The invention defined in claim 32 which comprises a third antenna element and a fourth antenna element like said first and second elements, respectively, said third and fourth elements being disposed in a plane which is substantially parallel to said first mentioned plane and generally parallel to, and in juxtaposition to, said first and second antenna elements, respectively.

38. The invention defined in claim 37 in which the inner ends of said first, second, third and iourth elements are disposed in a third plane which is substantially perpendicular to said first mentioned and said second plane.

* * * * *